US010612196B2

(12) United States Patent
Johnson et al.

(10) Patent No.: US 10,612,196 B2
(45) Date of Patent: Apr. 7, 2020

(54) MOLDBOARD SUPPORT STRUCTURE FOR A MILLING MACHINE

(71) Applicant: Caterpillar Paving Products, Inc., Brooklyn Park, MN (US)

(72) Inventors: Nick Johnson, Dayton, MN (US); Terry Wills, Shakopee, MN (US); Nicholas Argenziano, Otsego, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 115 days.

(21) Appl. No.: 15/847,194

(22) Filed: Dec. 19, 2017

(65) Prior Publication Data

US 2019/0186087 A1 Jun. 20, 2019

(51) Int. Cl.
*E01C 23/08* (2006.01)
*E01C 23/088* (2006.01)

(52) U.S. Cl.
CPC ..... *E01C 23/088* (2013.01)

(58) Field of Classification Search
CPC ..... E01C 23/088; E01C 23/127
See application file for complete search history.

(56) References Cited

U.S. PATENT DOCUMENTS

| | | | | | |
|---|---|---|---|---|---|
| 2,646,633 | A * | 7/1953 | Jahn | E02F 3/7659 | 172/782 |
| 4,009,530 | A * | 3/1977 | Eftefield | E02F 3/64 | 37/430 |
| 4,387,929 | A | 6/1983 | Wirtgen | | |
| 4,793,733 | A | 12/1988 | Chiba et al. | | |
| 5,209,307 | A * | 5/1993 | Hotte | E01C 19/203 | 172/445.2 |
| 5,265,975 | A | 11/1993 | Scott | | |
| 5,474,397 | A * | 12/1995 | Lyons | E01C 23/088 | 299/39.5 |
| 5,511,329 | A * | 4/1996 | Mickelson | E02F 3/386 | 37/468 |
| 5,535,621 | A | 7/1996 | Glidewell et al. | | |
| 7,438,364 | B2 * | 10/2008 | Boehme | E01C 23/088 | 299/39.4 |
| 2008/0129103 | A1 | 6/2008 | Hall et al. | | |

FOREIGN PATENT DOCUMENTS

| | | |
|---|---|---|
| DE | 2412172 | 6/1987 |
| DE | 102014006833 | 6/2016 |
| GB | 1032455 | 6/1966 |

* cited by examiner

*Primary Examiner* — Janine M Kreck
(74) *Attorney, Agent, or Firm* — Bookoff McAndrews

(57) ABSTRACT

A milling machine includes a frame, a ground engaging rotor assembly, a moldboard, and a hydraulic cylinder including a piston rod and a piston barrel. The ground engaging rotor assembly is at least partially enclosed by the moldboard. The moldboard is vertically movable via the hydraulic cylinder, and the hydraulic cylinder is coupled to the frame via a dual-trunnion assembly.

16 Claims, 3 Drawing Sheets

MOLDBOARD SUPPORT STRUCTURE FOR A MILLING MACHINE

TECHNICAL FIELD

The present disclosure relates generally to a road construction machine, and more particularly, to a moldboard support structure for the machine.

BACKGROUND

The present invention relates to milling machines that are used in road surface repairs. Milling machines are typically utilized to remove a layer or layers of old or defective road surface in preparation for resurfacing. Resurfacing an existing road surface with such defects may result in a perpetuation of prior existing conditions, especially if the road surface is exposed to heavy and/or continuous traffic which often requires the road to be resurfaced again within a short period of time. Milling may also provide a renewable source of aggregate such as recycled asphalt that may be used to resurface milled surfaces.

Many milling machines direct milled road fragments towards a conveyer which takes the fragments off the road, however, a significant amount of debris, aggregate, and fragments remain on the milled surface. When using asphalt or other pavement material to resurface a road, the milled surface must be substantially clean of any residue material before a new layer of asphalt can be deposited. Failure to clear the milled surface of such material may result in poor bonding between the new asphalt and the milled surface. Typically a sweeper will come along after the milling machine to remove of the debris, but often this is inefficient and uneconomical. Moreover, it is important for the milling machine to be able to follow and/or track the road surface and its contours being milled while both travelling straight and making curves.

U.S. Pat. No. 7,438,364, issued to Boehme et al. on Oct. 21, 2008 ("the '364 patent"), describes a scraper blade for a milling construction machine to help scrape milled material from behind a milling drum in order to yield a clean milled surface. The scrapper blade includes a blade that trails behind the milling drum, and is adjustable via a piston cylinder unit. The scrapper blade may be secured in a lowered position with a guide in the rear of the milling construction machine. The scraper blade and piston cylinder unit of the '364 patent may not provide sufficient degrees of freedom of movement, and thus, may introduce problematic bending forces on the piston cylinder unit. The moldboard support structure of the present disclosure may solve one or more of the problems set forth above and/or other problems in the art. The scope of the current disclosure, however, is defined by the attached claims, and not by the ability to solve any specific problem.

SUMMARY

In one aspect, a milling machine may include a frame, a ground-engaging rotor assembly, a moldboard, and a hydraulic cylinder including a piston rod and a piston barrel. The ground-engaging rotor assembly may be at least partially enclosed by the moldboard. The moldboard may be vertically moveable via the hydraulic cylinder, and the hydraulic cylinder may be coupled to the frame via a dual-trunnion assembly.

The piston rod may include a coupling portion configured to pivotably couple the piston rod to the moldboard. The milling machine may further include a bearing including a spherical portion, and the spherical portion may mate with the coupling portion of the piston rod. The bearing may further include at least one cylindrical end portion engaging at least one projection of the moldboard. When the piston rod is coupled to the at least one projection, there may be a gap between the coupling portion of the piston rod and the at least one projection such that the coupling portion is pivotable around at least a portion of the spherical portion of the bearing.

The dual-trunnion assembly may include a first cradle mount and a second cradle mount. The second cradle mount may include two cradle pins configured to be received within and pivot relative to the first cradle mount in a first direction, and the piston barrel may include two piston pins configured to be received within and pivot relative to the second cradle mount in a second direction different from the first direction. The first and second cradle mounts may include central openings to allow the piston barrel to extend through and pivot relative to the first and second cradle mounts. The first cradle mount may include a plurality of through holes configured to receive a plurality of fasteners to couple the dual-trunnion assembly to the frame or to the ground-engaging rotor assembly. The dual-trunnion assembly may be coupled to the machine in a central portion of a rear of the machine. The dual-trunnion assembly may be configured to allow for the hydraulic cylinder to pivot in at least two directions based on the position and movement of the moldboard.

The milling machine may further include a safety latch coupled to a bottom portion of the first cradle mount, and the safety latch may be pivotable relative to the first cradle mount. The safety latch may include a hook portion configured to secure a portion of the moldboard when the moldboard is in a raised position.

In another aspect, a milling machine may comprise a milling assembly and a moldboard positioned to the rear of the milling assembly, where a bottom portion of the moldboard includes at least one projection. The milling machine may also include a hydraulic cylinder coupling the moldboard to the milling assembly, and the hydraulic cylinder may be coupled to the moldboard with a spherical portion extending through an end portion of the hydraulic cylinder and through the at least one projection. The hydraulic cylinder may have at least two degrees of freedom of movement relative to the milled assembly.

The milling machine may further comprise a first cradle mount and a second cradle mount, and the hydraulic cylinder may be coupled to the milling assembly via the first cradle mount and the second cradle mount. The first cradle mount may be mounted on a middle portion of the milling assembly. The milling machine may further comprise a safety latch pivotably coupled to the first cradle mount and including a hook portion. The milling machine may also include a handle coupled to the moldboard. The handle may be configured to be securely positioned within the hook portion to secure the moldboard in a raised position.

In yet another aspect, a moldboard mounting assembly may include a hydraulic cylinder, including a piston rod and a piston barrel, where the piston barrel includes two piston pins. The moldboard mounting assembly may also include a first cradle mount and a second cradle mount, where the second cradle mount includes two cradle pins. The second cradle mount may be pivotable in a first direction relative to the first cradle mount, and the piston barrel may be pivotable in a second direction relative to the second cradle mount.

The first cradle mount may be fixedly coupled to a machine. The moldboard mounting assembly may further include a bearing, and a central portion of the bearing may include a spherical portion configured to be received within a mating portion of the piston rod. The moldboard mounting assembly may further include a notched lever extending from and pivotable relative to the first cradle mount.

DETAILED DESCRIPTION

Both the foregoing general description and the following detailed description are exemplary and explanatory only and are not restrictive of the features, as claimed. As used herein, the terms "comprises," "comprising," "having," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus.

For the purpose of this disclosure, the term "ground surface" is broadly used to refer to all types of surfaces that form typical roadways (e.g., asphalt, cement, clay, sand, dirt, etc.) or can be milled in the removal or formation of roadways. In this disclosure, relative terms, such as, for example, "about," "substantially," and "approximately" are used to indicate a possible variation of ±10% in a stated value. Although the current disclosure is described with reference to a milling machine, this is only exemplary. In general, the current disclosure can be applied as to any machine, such as, for example, a cold planer, reclaimer, or another milling-type machine.

Figure 1:
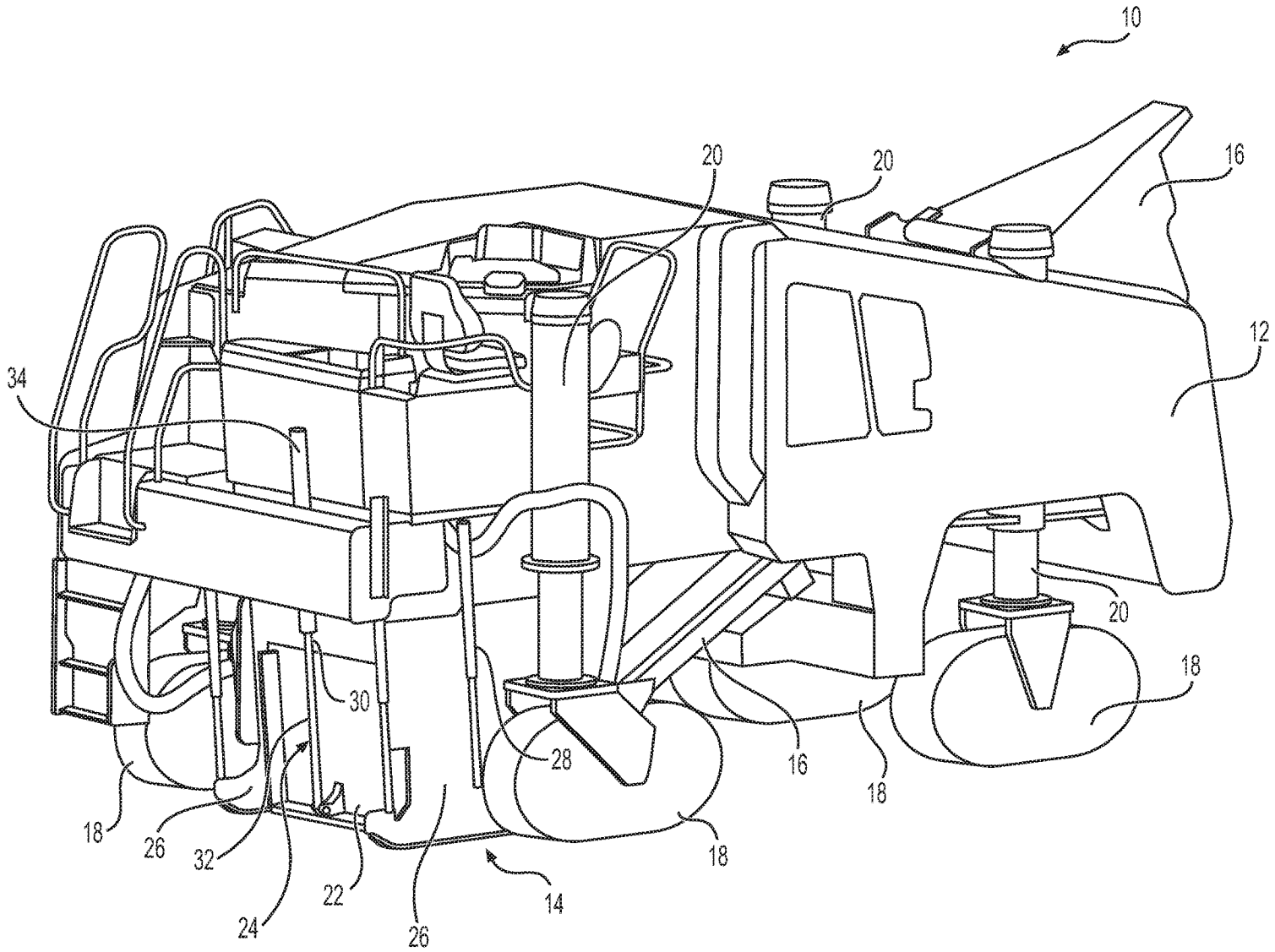
FIG. 1 is an illustration of one configuration of an exemplary machine.

FIG. 1 illustrates a perspective view of an exemplary milling machine 10, according to the present disclosure. Machine 10 includes a frame 12 and a milling assembly 14 positioned on the underside of frame 12. Milling assembly 14 may be integrally formed with frame 12 or may be otherwise coupled to milling assembly 14. Machine 10 also includes a conveyor assembly 16 configured to advance the milled material from milling assembly 14 away from the ground surface, for example, to be deposited into a bed of a truck. Machine 10 includes a plurality of wheels or track members 18 coupled to frame 12 via a plurality of hydraulic cylinders 20. Machine 10 also includes a moldboard 22 positioned to the rear of milling assembly 14 via a moldboard support structure 24.

It is noted that milling assembly 14 may include side doors 26 on each side portion of milling assembly 14. Moldboard 22 and side doors 26 enclose an interior rotor or milling drum assembly (not shown) that engages and mills the ground surface. Each side door 26 may be movably coupled to frame 12 via at least one side hydraulic cylinder 28, for example, in order to raise the side door 26 to inspect or repair milling assembly 14 and/or the internal drum assembly.

Moldboard 22 may help milling assembly 14 to remove the ground surface by removing any loose aggregate or debris that has not been captured by the milling drum assembly. Moldboard 22 may help to push the loose aggregate back toward the milling drum assembly, which may then urge the aggregate to conveyor assembly 16. Removing the loose aggregate may help yield a clean and smooth milled surface behind machine 10, which may then be more easily resurfaced. In order to further urge any loose aggregate toward the milling drum assembly, moldboard 22 may also include an angled interior surface and/or nozzles to dispense fluid. As discussed in greater detail below, moldboard support structure 24 connecting moldboard 22 to machine 10 may help increase the range and degrees of freedom of motion of moldboard 22 to accurately traverse the ground surface, without introducing bending or other strains on moldboard support structure 24.

Moldboard 22 is mounted to a rear portion of machine 10 via moldboard support structure 24. Moldboard support structure 24 includes a rear hydraulic cylinder 30. Rear hydraulic cylinder 30 includes a piston rod 32 movable within and extending out of a piston barrel 34. The movement and position of piston rod 32 relative to piston barrel 34 depends on the movement and pressure of hydraulic fluid, as is known to one having skill in the art. Moldboard support structure 24 also includes a trunnion mount 52 (FIGS. 2 and 3), and trunnion mount 52 may be coupled to piston barrel 34 in order to couple rear hydraulic cylinder 30 to milling assembly 14 or to frame 12. Trunnion mount 52 may allow rear hydraulic cylinder 30 to pivot in one or more directions. In one aspect, the connection of rear hydraulic cylinder 30 to machine 10 may include at least one U-joint trunnion mount, for example, a dual trunnion mount including two U-joint trunnion mounts. Moldboard support structure 24 may also include a bearing 36 (FIG. 2) coupling moldboard 22 to piston rod 32. For example, rear hydraulic cylinder 30 may be connected to a bottom portion of moldboard 22 via bearing 36. In one aspect, bearing 36 may include a spherical portion 64 (FIG. 3), allowing rear hydraulic cylinder 30 to pivot in at least one direction relative to the bottom portion of moldboard 22.

Figure 2:
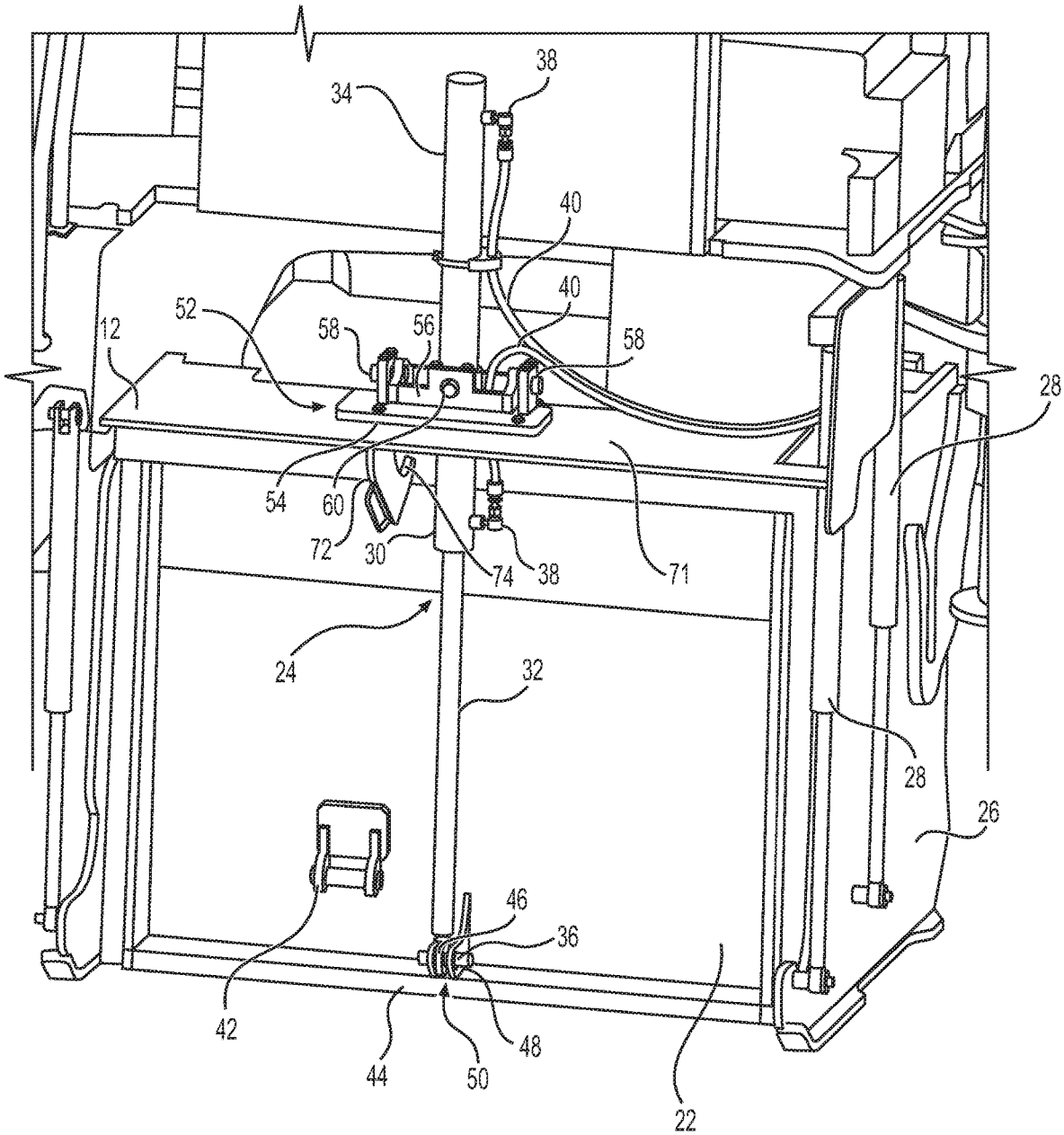
FIG. 2 is an illustration of a rear view of a portion of the machine of FIG. 1.

FIG. 2 shows moldboard support structure 24 connecting moldboard 22 to machine 10. It is noted that portions of machine 10 are removed in FIG. 2 in order to more clearly illustrate these connections and other pertinent aspects of this disclosure. Rear hydraulic cylinder 30 includes at least two fluid ports 38 coupled to at least two hydraulic fluid lines 40 in order to selectively raise or lower piston rod 32, and accordingly raise or lower moldboard 22. It may be necessary to raise or lower moldboard 22 in order to ensure that moldboard 22 follows the ground surface during milling and urges any loose aggregate back toward milling assembly 14 and the milling drum assembly for removal. Moldboard 22 may include a handle 42 to allow a user to grip and/or manipulate moldboard 22, for example, during inspection or repairs. It is also noted that FIG. 2 illustrates side door 26 being movably coupled to frame 12 via two side hydraulic cylinders 28 positioned, for example, at a front portion and a rear portion of side door 26.

As discussed above, rear hydraulic cylinder 30 may be coupled to moldboard 22 via bearing 36, and bearing 36 may be a cylindrical rod. Bearing 36 may allow relative movement between moldboard 22 and rear hydraulic cylinder 30, and may reduce the likelihood of wear on both components. Bearing 36 may couple a bottom portion 44 of moldboard 22 to a piston coupling 46 at a bottom of piston rod 32. Bottom portion 44 of moldboard 22 may include one or more projections 48. Piston coupling 46 and one or more projections 48 may be circular. Piston coupling 46 may be positioned adjacent to one projection 48 or between two projections 48. Bearing 36 may then pass through piston coupling 44 and the one or more projections 48. The coupling may provide for a gap 50 on one or both sides of piston coupling 46 of rear hydraulic cylinder 30. In one aspect, bearing 36 may include a centrally disposed spherical portion 64 (FIG. 3) at least partially positioned within piston coupling 46, and piston coupling 46 may include a curved surface that mates with the curved surface of spherical portion 64. Bearing 36 may also include at least one cylindrical end portion extending from spherical portion 64, and the at least one cylindrical end portion may include an end cap (not shown). The cylindrical end portions may engage at least one projection 48 of moldboard 22. The remaining portion of spherical portion 64 may extend beyond piston coupling 46, and projections 48 may include openings sized to receive the cylindrical end portions, and not to enclose the remaining portion of spherical portion 64, thus forming gap 50 between the piston coupling 46 and projection 48. Gap 50 may increase the relative freedom of movement between rear hydraulic cylinder 30 and moldboard 22 during operation of machine 10.

Figure 3:
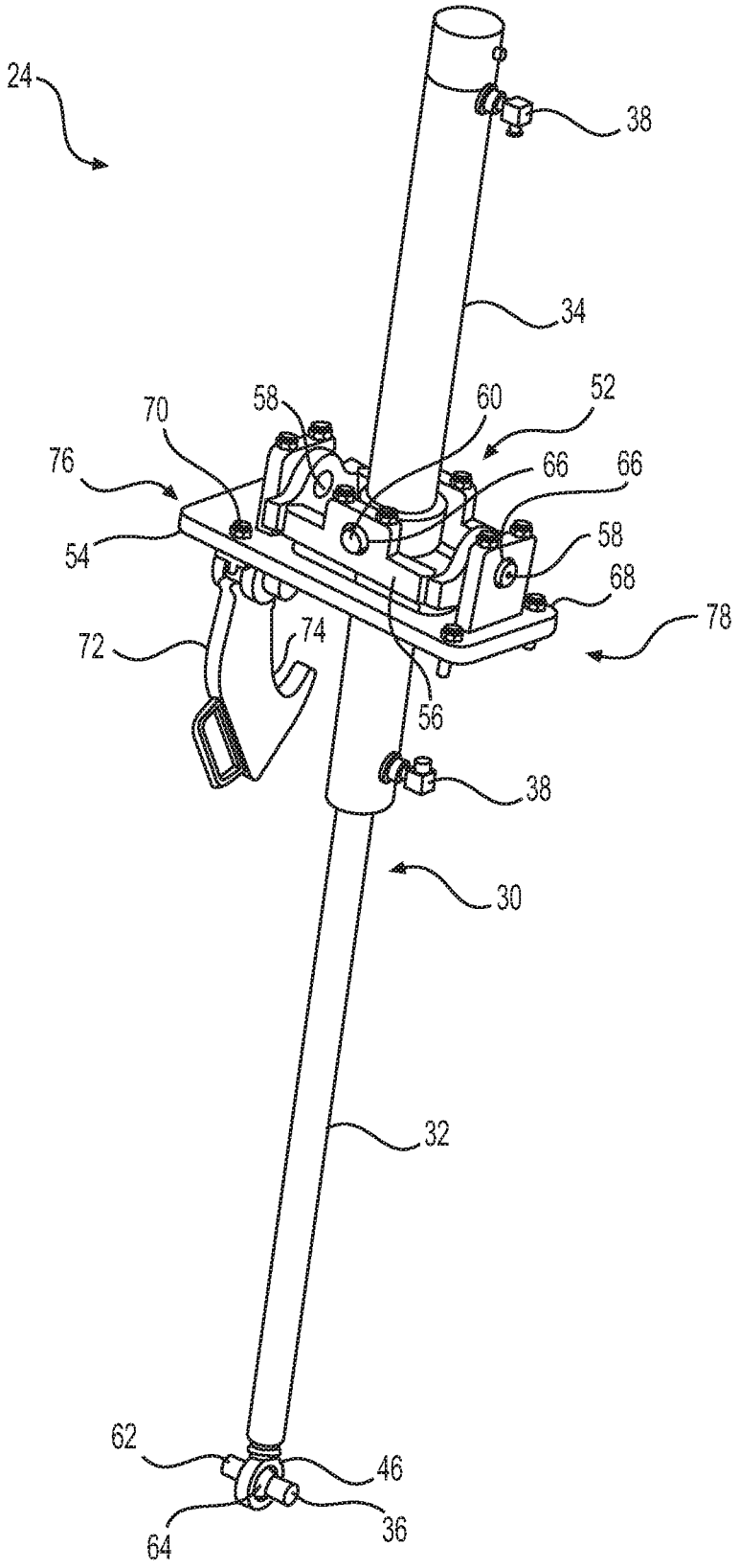
FIG. 3 is a perspective view of a portion of the machine of FIG. 1.

As noted above, rear hydraulic cylinder 30 may be coupled to machine 10 via a trunnion mount 52. Rear hydraulic cylinder 30 may be "mid-mounted" to machine 10, meaning that rear hydraulic cylinder 30 is coupled to a middle or central portion along the height of machine 10. Piston barrel 34 may be mounted on or positioned substantially even with a top portion of milling assembly 14, and below a user operation position. Trunnion mount 52 may be bolted to a top portion of milling assembly 14 or directly to frame 12. Trunnion mount 52 may be a dual-trunnion mount or double U-joint trunnion mount. As best shown in FIG. 3, trunnion mount 52 may include a first cradle mount 54 and a second cradle mount 56. Both first cradle mount 54 and second cradle mount 56 include central openings to accommodate rear hydraulic cylinder 30. First cradle mount 54 may be bolted or otherwise secured to milling assembly 14 or frame 12. Second cradle mount 56 includes two cradle pins 58, and cradle pins 58 are rotatably mounted in first cradle mount 54. As such, second cradle mount 56 is pivotable in a first direction relative to first cradle mount 54. Then, rear hydraulic cylinder 30 includes two piston pins 60, for example, extending from piston barrel 34. Piston pins 60 are rotatably mounted in second cradle mount 56. As such, rear hydraulic cylinder 30 is pivotable in a second direction relative to second cradle mount 56, and the second direction may be different (e.g., normal) from the first direction. Accordingly, rear hydraulic cylinder 30 is pivotable in first and second directions relative to milling assembly 14 or frame 12 (whichever element rear hydraulic cylinder 30 is coupled to via trunnion mount 52). Trunnion mount 52 allows for two directions of motion, or two degrees of freedom, for rear hydraulic cylinder 30. Therefore, rear hydraulic cylinder 30 may be able to raise and lower moldboard 22 to follow the ground surface during a milling process, and also be able to pivot with moldboard 22 as moldboard 22 follows the ground surface without introducing a bending moment, torques, or other potentially problematic forces on rear hydraulic cylinder 30.

FIG. 3 illustrates additional components and features that may be included in moldboard support structure 24 to couple moldboard 22 to machine 10. As discussed above, rear hydraulic cylinder 30 includes at least two fluid ports 38 for delivery or removal of hydraulic fluid to raise or lower piston rod 32 within piston barrel 34. Bearing 36 may be a generally cylindrical rod 62, which may include a centrally disposed spherical portion 64. Spherical portion 64 may be positioned in piston coupling 46 of rear hydraulic cylinder 30. Bearing 36 may couple piston coupling 46 to one or more projections 48 of moldboard 30 to form gap 50 (FIG. 2) on either or both sides of piston coupling 46 to increase the relative freedom of movement between rear hydraulic cylinder 30 and moldboard 22 during operation of machine 10.

As discussed above, trunnion mount 52 includes first cradle mount 54 and second cradle mount 56. Both first cradle mount 54 and second cradle mount 56 each include two cylindrical through holes 66. Cradle pins 58 and piston pins 60 fit through cylindrical through holes 66 of the respective cradle mounts 54, 56 to allow for the two degrees of movement discussed above. Cylindrical through holes 66 may be bushings, which may reduce friction and decrease the necessary maintenance. First cradle mount 54 may also include vertical through holes 68 such that first cradle mount 54 may be fixedly coupled to machine 10 via one or more locking elements or fasteners 70, such as, screws or bolts. It is noted that first cradle mount 54 and second cradle mount 56 may each include a bottom part and a top part, with the two parts being coupled to form cylindrical through holes 66. For example, cradle pins 58 or piston pins 60 may be position on the bottom part, and the top part may be coupled to the bottom part to form cylindrical through holes 66 with cradle pins 58 and piston pins 60 pivotably secured within cylindrical through holes 66. It is further noted that first cradle mount 54 may be connected to milling assembly 14 or frame 12 via an extension piece 71 extending to the rear of milling assembly 14 or frame 12. Extension piece 71 includes a central opening or cutout (not shown) such that rear hydraulic cylinder 30 may move in the first and second directions as discussed above without affecting or contacting milling assembly 14 or frame 12.

Additionally, a safety latch 72 with a vertically facing notched or hook portion 74 may be pivotably coupled to a bottom portion of first cradle mount 54. A first side 76 of first cradle mount 54 may extend away from rear hydraulic cylinder 30 a greater distance than a second side 78 of first cradle mount 54 in order for safety latch 72 to be coupled to a bottom portion of first side 76. Safety latch 72 may extend from either the left or right side of first cradle mount 54 when viewed toward the direction of motion of machine 10. Safety latch 72 may allow a user to lockably position moldboard 22 in a raised position, exposing the interior of milling assembly 14 and the milling drum assembly. For example, as discussed above, moldboard 30 may include handle 42 (FIG. 2). A user may use handle 42 to lift moldboard 30 vertically away from the ground surface. Alternatively, rear hydraulic cylinder 30 may be activated to raise piston rod 32, and thus raise moldboard 22. Safety latch 72 may be pivoted away from machine 10 as moldboard 22 is raised, and safety latch 72 may then be pivoted toward machine 10 to secure handle 42 within hook portion 74. Securing handle 42 within hook portion 74 helps to ensure that moldboard 22 remains in the raised position during the inspection or repair of the interior of milling assembly 14 and the milling drum assembly. After the inspection or repair, a user may again pivot safety latch 72 away from machine 10, allowing moldboard 22 to extend downward toward the ground surface.

Because moldboard 22 is coupled to machine 10 via rear hydraulic cylinder 30, bearing 36, and trunnion mount 52, moldboard 22 may more closely follow contours of the ground surface, including as machine 10 makes turns. Additionally, if moldboard 22 rotates, twists, or otherwise experiences forces, bearing 36 and trunnion mount 52 help to ensure a stable connection between moldboard 22 and rear hydraulic cylinder 30 without bending, side loading, or otherwise introducing problematic forces on piston rod 32, piston barrel 34, or at the connection of rear hydraulic cylinder 30 to machine 10. As such, machine 10 and moldboard 22 may yield a clean and smooth milled surface after machine 10 passes over the ground surface. Additionally, because rear hydraulic cylinder 30 is mid-mounted to machine 10 as discussed above, a user operating machine 10 may have a clear vertical view of the milled portion of the ground surface.

INDUSTRIAL APPLICABILITY

The disclosed aspects of machine 10 may be used in any milling machine to assist in removal of the milled material, while allowing for variations in milling depth and rotor service. During operation, moldboard 22 may be positioned into the milled cut within the ground surface, and may help to direct the milled material toward the rotor drum and away from machine 10 via conveyor assembly 16. Moldboard 22 may experience torques and other forces as machine 10 traverses and mills the ground surface. The forces on moldboard 22 may be especially strong when machine 10 turns or if the ground surface includes irregularities. Nevertheless, bearing 36 connecting moldboard 22 to piston rod 32 allows for relative movement between the two elements. Moreover, if the movement of moldboard 22 imparts a force on piston rod 32, rear hydraulic cylinder 30 may pivot in at least two directions via trunnion mount 52 as discussed above. Therefore, the aforementioned moldboard mounting assembly assists in reducing forces from being imparted on rear hydraulic cylinder 30, reducing the likelihood of bending moments or other issues affecting rear hydraulic cylinder 30, even as moldboard 22 pivots, translates, and otherwise traverses the ground surface while machine 10 travels to form straight or curved milled cuts. Additionally, the position of rear hydraulic cylinder 30 and its mounting via trunnion mount 52 assists an operator by allowing a clear vertical view to the rear of machine 10 to observe the milled portion of the ground surface that machine 10 has passed over.

It will be apparent to those skilled in the art that various modifications and variations can be made to the disclosed machine without departing from the scope of the disclosure. Other embodiments of the machine will be apparent to those skilled in the art from consideration of the specification and practice of the moldboard support structure disclosed herein. It is intended that the specification and examples be considered as exemplary only, with a true scope of the disclosure being indicated by the following claims and their equivalents.

What is claimed is:

1. A milling machine, comprising a frame;

a ground-engaging rotor assembly;

a moldboard including at least one projection on a bottom portion of the moldboard;

a bearing including a spherical portion and cylindrical end portions extending from opposing sides of the spherical portion, wherein at least one of the cylindrical end portions engages with the at least one projection of the moldboard; and a hydraulic cylinder including a piston rod and a piston barrel, wherein the piston rod includes a coupling portion that is coupled to the spherical portion of the bearing such that the coupling portion of the piston rod is pivotable around at least a portion of the spherical portion of the bearing to provide a range of motion for the hydraulic cylinder relative to the moldboard, wherein the ground-engaging rotor assembly is at least partially enclosed by the moldboard, wherein the moldboard is vertically moveable via the hydraulic cylinder, and wherein the hydraulic cylinder is coupled to the frame via a dual-trunnion assembly, and wherein the dual-trunnion assembly is coupled to the machine in a central portion of a rear of the machine and to a central portion along a length of the hydraulic cylinder, wherein the dual-trunnion assembly is configured to provide a range of motion for the hydraulic cylinder relative to the machine in two directions, and wherein the piston rod of the hydraulic cylinder is pivotably coupled to a bottom portion of the moldboard.

2. The milling machine of claim 1, wherein when the piston rod is coupled to the at least one projection, there is a gap between the coupling portion of the piston rod and the at least one projection such that the coupling portion is pivotable around at least a portion of the spherical portion of the bearing.

3. The milling machine of claim 1, wherein the dual-trunnion assembly includes a first cradle mount and a second cradle mount.

4. The milling machine of claim 3, wherein the second cradle mount includes two cradle pins configured to be received within and pivot relative to the first cradle mount in a first direction, and wherein the piston barrel includes two piston pins configured to be received within and pivot relative to the second cradle mount in a second direction different from the first direction.

5. The milling machine of claim 4, wherein the first and second cradle mounts include central openings to allow the piston barrel to extend through and pivot relative to the first and second cradle mounts.

6. The milling machine of claim 4, wherein the first cradle mount includes a plurality of through holes configured to receive a plurality of fasteners to couple the dual-trunnion assembly to the frame or to the ground-engaging rotor assembly.

7. The milling machine of claim 3, further including a safety latch coupled to a bottom portion of the first cradle mount, wherein the safety latch is pivotable relative to the first cradle mount, and wherein the safety latch includes a hook portion configured to secure a portion of the moldboard when the moldboard is in a raised position.

8. The milling machine of claim 1, wherein the dual-trunnion assembly is configured to allow for the hydraulic cylinder to pivot both left to right and forward to backward, relative to a direction of movement of the milling machine, based on the position and movement of the moldboard.

9. A milling machine, comprising:

a milling assembly;

a moldboard positioned to the rear of the milling assembly, wherein a bottom portion of the moldboard includes at least one projection;

a hydraulic cylinder coupling the moldboard to the milling assembly, wherein the hydraulic cylinder is coupled to the moldboard with a spherical portion extending through an end portion of the hydraulic cylinder and through the at least one projection, and wherein the hydraulic cylinder has at least two degrees of freedom of movement relative to the milling assembly;

a safety latch pivotably coupled to a first cradle mount and including a hook portion; and a handle coupled to the moldboard, wherein the handle is configured to be positioned within the hook portion to secure the moldboard in a raised position.

10. The milling machine of claim 9, further comprising a second cradle mount, and wherein the hydraulic cylinder is coupled to the milling assembly via the first cradle mount and the second cradle mount.

11. The milling machine of claim 10, wherein the first cradle mount is mounted on a central portion of the milling assembly.

12. A moldboard mounting assembly, comprising:

a hydraulic cylinder, including a piston rod and a piston barrel, wherein the piston barrel includes two piston pins;

a first cradle mount;

a second cradle mount, including two cradle pins; and a safety latch coupled to a bottom portion of the first cradle mount, wherein the safety latch is movable relative to the first cradle mount, and wherein the safety latch includes a hook portion configured to secure a portion of a moldboard, wherein the second cradle mount is pivotable in a first direction relative to the first cradle mount, and wherein the piston barrel is pivotable in a second direction relative to the second cradle mount.

13. The moldboard mounting assembly of claim 12, wherein the first cradle mount is fixedly coupled to a machine.

14. The moldboard mounting assembly of claim 12, further including a bearing, wherein a central portion of the bearing includes a spherical portion configured to be received within a mating portion of the piston rod.

15. The moldboard mounting assembly of claim 12, wherein the safety latch is pivotable relative to the first cradle mount.

16. The moldboard mounting assembly of claim 12, wherein the hook portion is configured to secure the portion of the moldboard in a raised position.

* * * * *